United States Patent [19]

Venot

[11] 4,115,985

[45] Sep. 26, 1978

[54] METHOD OF APPARATUS FOR THE THERMAL TREATMENT OF TEXTILES ARTICLES

[75] Inventor: Jean Venot, Roanne, France

[73] Assignee: ASA S.A., Roanne, France

[21] Appl. No.: 814,381

[22] Filed: Jul. 11, 1977

[30] Foreign Application Priority Data

Jul. 12, 1976 [FR] France ..... 76 21371

[51] Int. Cl.[2] ..... D02G 1/02; D01H 13/28

[52] U.S. Cl. ..... 57/34 HS; 57/157 TS

[58] Field of Search ..... 57/34 HS, 157 TS, 34 R, 57/35, 51

[56] References Cited

U.S. PATENT DOCUMENTS

| | | | |
|---|---|---|---|
| 3,093,955 | 6/1963 | Cadorio | 57/34 HS |
| 3,367,006 | 2/1968 | Mattingly | 57/34 HS X |
| 3,646,744 | 3/1972 | Rusca | 57/34 HS X |
| 3,791,120 | 2/1974 | Hess | 57/34 HS |
| 3,796,036 | 3/1974 | Parker | 57/34 HS X |

*Primary Examiner*—Donald Watkins

*Attorney, Agent, or Firm*—Arnold, White & Durkee

[57] ABSTRACT

A method and apparatus for the thermal treatment of textile articles in which a moving yarn is delivered from a yarn supply and a main thermal treatment is carried out in a conventional manner by contact with a heated oven, the yarn is cooled and a false twist is applied which feeds back to the main thermal treatment zone. The yarn is then subjected to a further heat treatment and the untwisted yarn is rewound. The yarn is subjected to a complementary heat treatment before and/or after the main thermal treatment by wetting the yarn and then heating it by high frequency heating.

7 Claims, 3 Drawing Figures

METHOD OF APPARATUS FOR THE THERMAL TREATMENT OF TEXTILES ARTICLES

The present invention relates to a method and apparatus for the thermal treatment of textile articles.

It concerns more particularly an improved method and apparatus for the thermal treatment of yarn, displaced at high speed, for example, during a texturising operation by false twist.

In the remainder of the description the invention will be described applied to a method of false-twisting texturising in which one subjects the moving yarn to a temporary twist and to a thermal treatment in the twisted state, the yarn being eventually subjected before rewinding to a second thermal treatment.

It is clear that this does not limit the scope of the invention and that it can equally be applied to all methods in which one thermally treats a moving yarn.

In the description by yarn, one designates not only continuous mono or multifilament yarn but also spun fibre yarns.

In all the methods of treatment of yarn, involving a thermal treatment, and more especially in false-twist texturising, the principle problem which poses itself is that of calorific transmission, the heat needing to penetrate regularly and uniformly along the whole length of the yarn.

In fact the temperature of treatment and its regularity have a great influence on the textile qualities of the yarn and notably its dying affinity.

It is well known that the thermal treatment should vary as a function of the material treated, of the count of the yarn and of its speed of passage. Clearly the heat reaches more rapidly the centre of a fine yarn than that of a large count yarn. At the same time, it is well known that one cannot treat a yarn above certain limited temperatures without degradation. This question of thermal exchange is a very important point in false twist texturising and the experts have envisaged many approaches by applying one of the three principles of thermal exchange, namely, convection, radiation or combustion or any combination thereof.

The principle of heating by convection consists in placing or causing the yarn to be treated to pass through a heated container. The calorific transmission is effected by means of hot air or of a vapour introduced into the container. This principle has been used in practice in the discontinuous or conventional method where, after having received the twist in the frame, the yarn is placed in a drying room so that this torsion can be fixed by plasticising.

It has equally been applied on continuous false twist spindles in which the yarn is fixed during its passage in a tube filled with vapour. This humid heating gives rise to a certain complexity resulting essentially from the precautions which need to be taken to ensure the fluid-tightness of the tubes with a view to limiting as much as possible the loss of vapour. These difficulties have caused this system to be abandoned.

A more practical application of this principle has been developed and it is still used. It uses a system of heating by hot air in a chamber heated by electrical resistances, with regulation at one point.

The hot air having a tendency to rise to the upper part of the vessel, it is very difficult to have a temperature regulation between the lower part and the upper part of said vessel. This defect increasing with the length of the vessel, it is impossible to produce ovens of great length according to this principle.

It should be noted equally that the yarn being unsupported and turning at a very high speed, it is necessary for it to be given a considerable attention during the operation of texturisation to neutralise the effects of centrifugal force.

The methods of heating based on the principle of thermal exchange by radiation have equally been developed thereafter. They consist in making the yarn pass a certain distance from a heating plate or through the interior of a straight tube of large diameter.

The calorific energy is provided either by vapour or hot oil, or again by electrical resistances. This system does not present any great advantage, because the yarns under small tension, do not contact the heating element. It has been used by certain manufacturers for the texturisation. The obtaining of a correct heating with this procedure requires one to take particular precautions, because the temperature varies excessively rapidly as a function of the distance between the heating element and the yarn.

It has also been proposed, notably in American Pat. No. 2,823,513, to apply the principle of conduction. It should be noted that it is this principle which is most utilised today, at least as far as concerns the thermal treatment effected upstream of a false twist spindle. In this case, many arrangements have been proposed, but the most utilised is that which consists in making the yarn move over a curved heating plate, so that it enables the thermal treatment to be effected in these optimum conditions of precision and of profitability.

It has also been proposed to utilise in the textile industry the well known principle of heating by high or hyper-frequency. If the application of this principle gives good results in certain cases, for example for the drying of bobbins of yarn, the drying of pieces of fabric or flock, it should be recognised that it has not been developed for texturising, although this application has been envisaged for more than twenty years again in U.S. Pat. No. 2,823,513 or French Pat. No. 1,159,710.

The non-development of this technique, in spite of the advantages of which it gives, with respect to the rapidity, the great energy saving, the absence of atmospheric pollution, are explained by the fact that it is very difficult to regulate the temperature and the obtaining of a precise treatment, a condition which is absolutely necessary in a good quality yarn.

Due to the fact of the improvement of the performance of false twist spindles, which are working at 15,000 turns per minute to more than 800,000 turns per minute, using conventional spindles and which exceeds the equivalent of several millions of turn per minute using friction spindles, and of the increase of the linear speed of the yarn, one has needed to increase the length of the oven for the yarn to receive sufficient heat for its heat treatment. Moreover, always following this increase of speed, one needs to provide means to recool the yarn between the oven and its passage through the false twist spindle, this cooling in general being obtained by an elongation of the path of the yarn through free air. This leads to a great increase of the size of the machines and to a greater complexity of setting up the yarn.

With regard to the cooling, it has been proposed to accelerate it by wetting the yarn. Such a method is described in U.S. Pat. No. 3,333,409. This latter technique, in spite of the rapidity of cooling that it permits is not however utilised due to the fact that it leads to a bad quality yarn having creasing faults, that is to say the yarns in which the filaments are regrouped one to the other in certain zones.

According to the present invention there is provided a method of texturising a moving yarn, comprising the steps of continuously:

(a) delivering a moving yarn from a yarn supply;
(b) carrying out a first thermal treatment on the yarn;
(c) cooling the yarn and communicating to it a false twist which feeds back to the first thermal treatment zone;
(d) subjecting the yarn to a further heat treatment;
(e) rewinding the untwisted yarn;
(f) subjecting the yarn to a complementary heat treatment associated at least with the first thermal treatment by wetting the yarn and then heating it by high frequency heating.

Such a method facilitates the operations of heating and cooling the yarn in particular during the treatment of texturisation by false twist. With this method it is possible considerably to reduce the size of the apparatus, notably false twist mills, while permitting this high speed production, it being possible to exceed 800 meters per minute, while conserving a high quality of the yarn obtained.

The method according to the invention has, at the same time, the advantages given by the method of treating by high or hyper-frequency, namely the rapidity and the great energy economy and those given by the prior methods and notably the method by conduction, namely the very high precision and control of the treatment, and above all in reducing the disadvantages of said method, and in particular in limiting the length of the treatment oven.

Moreover, with the method according to the invention, it is possible greatly to reduce the length of path of cooling of the yarn between the oven and the spindle.

At least the first thermal treatment to which the yarn is subjected during its displacement is associated with a complementary treatment which consists in dampening the yarn then in subjecting it to a heating by high frequency.

The complementary treatment of dampening and heating by high frequency can be effected, according to the invention, either before each of the conventional thermal treatments or between the first conventional thermal treatment and the false twist spindle, or in each of these zones.

When the complementary treatment is effected before a conventional thermal treatment, it permits the rapid preheating of the yarn and reduction notably of the length of the conventional thermal treatment ovens which follow.

When this complementary treatment is effected between the first thermal treatment and the false twist spindle, this permits great reduction of the length of path of recooling, the high frequency treatment being controlled in this case in a manner such that the temperature of the yarn which has been cooled by dampening does not exceed 80° C. to 90° C. after it has entered in the false twist spindle.

The frequencies of the high frequency field, are preferably from 10 to 10,000Mhz the choice of the frequency depending on the nature of the material and of the temperature to which one desires to raise it.

The invention also provides apparatus for texturising a moving yarn comprising:

(a) means for storing a supply of yarn,
(b) yarn delivery means,
(c) first thermal treatment means,
(d) yarn cooling means,
(e) a false twist producing means,
(f) further thermal treatment means,
(g) withdrawal and rewinding means,
(h) complementary heat treatment means associated with at least said first thermal treatment means and comprising means for wetting the yarn and subsequently to high frequency yarn heating means.

The wetting means and the high frequency yarn heating means may be disposed before each of the thermal treatments to which the yarn is subjected and/or between the first thermal treatment and the false-twist spindle.

In a preferred variant it comprises also, between the standard treatment oven and the element communicating to the yarn a false twist, dampening means for the yarn and a second applicator of high frequency.

As a generator of high frequency, one utilises electronic oscillators of a controllable voltage, utilising preferably the frequencies reserved for induction use. The applicators will be of any suitable form according to the frequencies utilised and may for example be of a cavity or piston type.

As the first heat treatment means one may use any type of conventional oven employed in texturisation, but advantageously an open or closed oven comprising a heated plate on which the yarn passes.

As dampeners, one may utilise any known means such as wet rollers, as illustrated in U.S. Pat. No. 3,333,409 or atomisers but advantageously one uses curtains of water traversed by the yarn.

The invention will be better understood from the following description, given merely by way of example, reference being made to the accompanying drawings in which.

Figure 1:
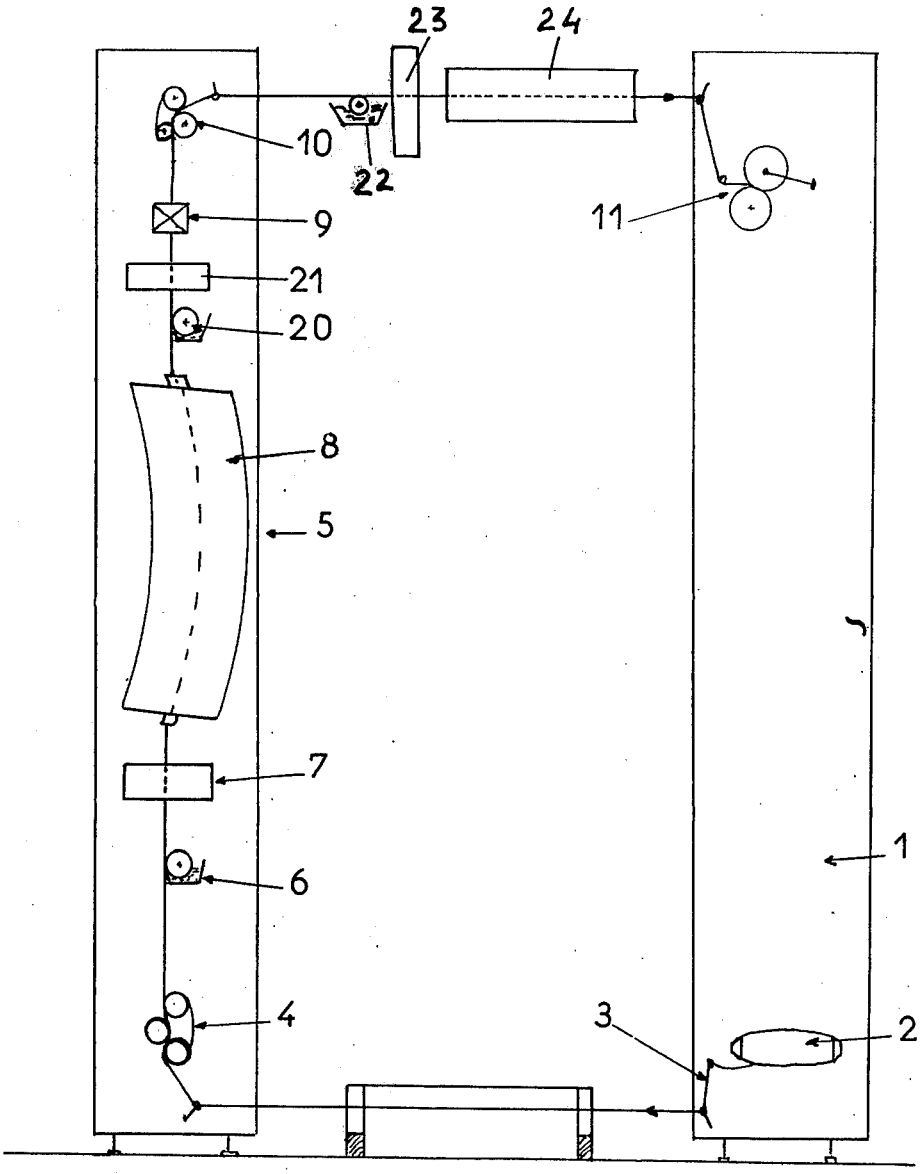
FIG. 1 illustrates the assembly of one embodiment of apparatus according to the invention.

If one refers to FIG. 1, the apparatus illustrated comprises a storage means 1 for yarn supports 2 for feeding yarn 3 by means of a yarn feeder 4; a thermal treatment zone 5 comprising a dampening member 6, a high frequency applicator 7, and an oven 8; a cooling zone constituted advantageously by a dampener and a high frequency field applicator 21, a false twist spindle 9, preferably of the external disc friction type, yarn withdrawal means 10 and yarn rewinding means 11 for the treated yarn and finally, preceding a second conventional thermal treatment oven 24, a dampening member 22 and a high frequency field applicator 23.

Figure 2:
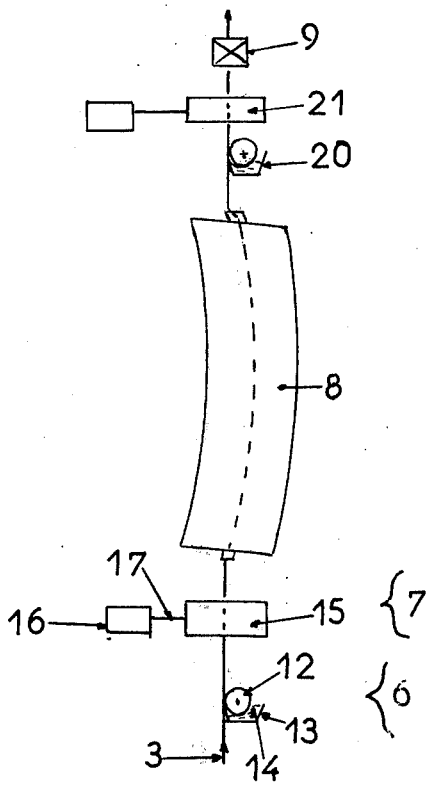
FIG. 2 illustrates in more detail one embodiment of the heating section of such an apparatus.

As is better shown by FIG. 2, the elements of the heat treatment zone comprise:

as the dampening member 6, a cylinder 12 partially immersed in a tank 13 containing the dampening liquid 14, the cylinder 12 being in contact with the yarn 3 to be treated.

the applicator 7 of the field will be chosen as a function of the frequency of treatment. Thus when one desires to work with high frequencies of between 0.5 and 100 Mhz it can be constituted by a pair of electrodes fed from an oscillator which can control the frequency by a variation of the inductance or capacitance of the tuned circuit, and when one works with frequencies of between 100 and 10,000 Mhz it can be constituted by a feed cavity for a wave guide of a magnetron;

the oven 8 is a conventional oven formed essentially from a heated plate 18 with which the moving yarn is in contact.

Figure 3:
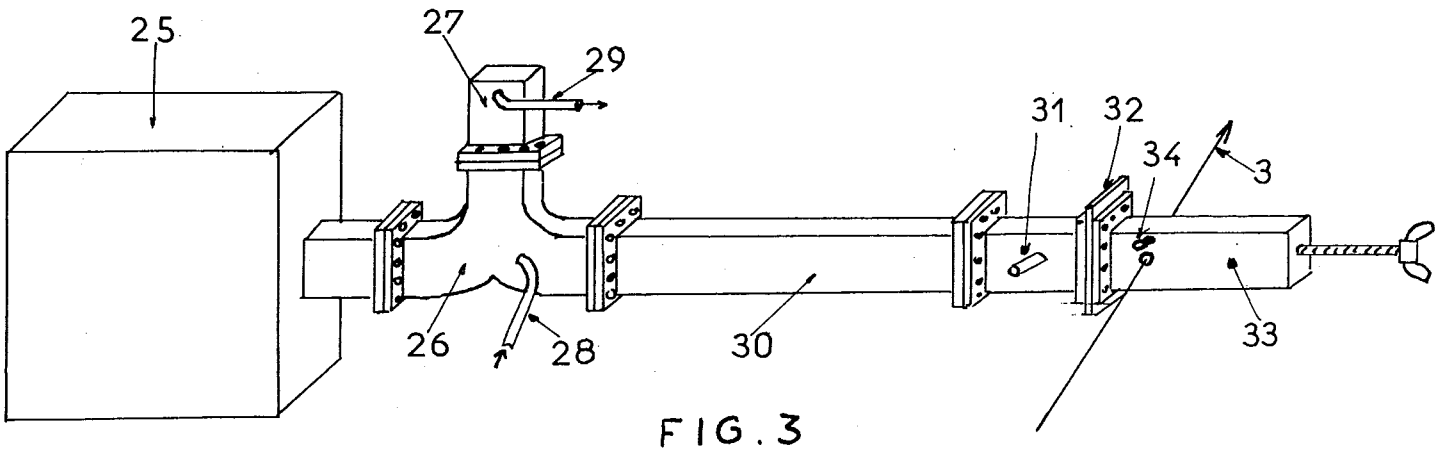
FIG. 3 illustrates in detail an apparatus for heating the yarn by high frequency.

FIG. 3 illustrates in detail one embodiment of device for heating the yarn by high frequency.

According to this embodiment the apparatus of treatment by high frequency, comprises:

a magnetron generator 25 of 2450 Mhz cooled by air, for example as sold by the company Radiotechnique under the name "Magnetron type YJ 15007";

a circulator 26 of the type F1152-12 sold by the company MARCONI permitting the projection of a magnetron against the wave reflectors and deviating it on an apparatus filled with water.

a water charge apparatus 27 for absorbing the reflected energy and fed by a water supply conduit 28 and a water evacuation conduit 29, an elongate wave guide 30 of a total length of 800 mm, a compressed air blowing member 31 permitting the evacuation of the vapours resulting from drying of the yarn, an iris 32 constituted by a plate of thickness 3 mm, provided at its centre by a hole of diameter 25 mm, permitting the realisation of an adaptation of an impedance to a level of the applicator, a piston applicator 33, comprising a piston of travel 90 mm permitting the tuning of a wave length returning the ratio of a stationary wave as close as possible to 1, being in practice, a maximum lighting of a little tuned mark 34 constituted by a simple lamp or neon of 220 volts, situated exactly on the axis of the passage of the yarn 3.

The elongate wave guide 30, the means for blowing compressed air and the applicator having a piston have been realised as part of a brass wave guide according to the American standard JAN RG/U 112.

The functioning of this apparatus is as follows:

The yarn 3 leaving the support 2 passes via the feed means 4, onto the wetting member 6 on which it is dampened, passes into the high frequency field where it is preheated towards 100° C. then into the oven 8, is cooled before entering in the false twist spindle 9 which communicates to it a twist which feeds back to the interior of the oven 8 and of a high frequency field 7 and is finally rewound in a conventional manner.

In the present case, the cooling is obtained by passing the yarn over a cylindrical dampener 20, then in drying it, before it enters into the spindle 9 by passing in a high frequency applicator 21. The field of the high frequency should be controlled in such a manner that the yarn should dry while not raising in temperature above 80°-100° C.

Finally, a second heat treatment, either conventional, or effected in the same manner according to the invention, can be applied to the yarn after the spindle 9 and before rewinding. The tensions communicated to the yarn during its different phases of operation, that is to say essentially between the feed means 4 and the spindle 9, between the spindle 9 and the withdrawal means 10, and between the withdrawal means 20 and the rewinding means are those currently applied during a conventional false twist treatment.

The invention and the advantages it produces will however be better understood from the following example given by way of non-limitation illustration.

For this example, one uses a false twist texturising mill shown in FIGS. 1 and 2 and comprising:

as a wetting member, a cylinder 12 of 15 centimeters diameter, rotatable, immersed in one third of its height in a tank 14 fed with water, the high frequency applicator 7 is constituted as described above and shown in FIG. 3, the oven 8 is a closed conventional oven acting by contact and having a length of 100 centimeters.

The cooling is obtained by means of a wetting member 20, placed between the oven 8 and the spindle 9, the drying of the yarn before its entry into the spindle being obtained by means of an applicator of high frequency 21 similar to the preceding applicator 7.

a spindle 9 utilised in a friction spindle;

the feeders 4 to 10 are conventional feeders.

EXAMPLE 1

On an installation illustrated by FIGS. 1 and 2, one treats a polyamide 6.6 yarn, having a count of 110 dtex and 34 filaments.

In this example, one does not subject the yarn to a thermal complementary treatment between the false-twist spindle and the winding.

The conditions of treatment are as follows:

feed speed of the feed mechanism 4: 1020 meters per minute, speed of the spindle 9: 14000 turns per minute, speed of feed of the withdrawal means 10: 1000 meters per minute, speed of rewinding 11: 980 meters per minute, high frequency applicators 7 controlled to 2450 Mhz, raising the yarn to a temperature of about 100° C., temperature of the oven 8 permitting giving to the yarn a temperature of the order of 200°;

high frequency applicator 21 controlled to 2450 Mhz.

The yarn obtained presents the characteristics (bulk, elasticity) if not better, at least identical to those of a yarn treated in a conventional manner at 400 meters per minute with a friction spindle turning at 6000 turns per minute.

EXAMPLE 2

One treats a polyester yarn partially drawn, and subjects it to a thermal fixation treatment after the passage in the false twist spindle and before rewinding.

The yarn is a partially drawn yarn, which, after drawing has a draw ratio of 1.68 having a count of 167 dtex. This yarn comprises 34 filaments. The conditions of the treatment are as follows:

false twist spindle: a friction twister having discs rotating at 7330 turns per minute, speed of feed of yarn: 600 meters per minute.

At each of the conventional ovens 8 and 24 and between the spindle 9 of the outlet of the first oven 8 one subjects the yarn to a treatment according to the invention consisting in a dampening followed by a heating by high frequency.

As in the preceding example the applicator of high frequency is controlled to 2450 Mhz.

The yarn obtained presents very good characteristics and one notes that the touch of the knitted fabrics produced at the start of the yarn is modified with respect to the touch of the knitted fabrics starting from the yarns treated in the conventional manner.

EXAMPLE 3

By way of comparison, it has been calculated that for the same speed of spindle and of passage of yarn, during the test carried out according to the invention, it would be necessary to use a closed oven acting by contact of the order of 3 meters length, for the yarn to be brought to the same temperature and maintained at this temperature for the same time. Moreover, the cooling path would have to have a length of 2.5 meters when one is utilising a cooling device 20 and a second high frequency applicator 21. The distance between the oven 8 and the spindle 9 has been greatly reduced. It is clear that such an apparatus having an oven of 3 meters length, and a cooling path of 2.5 meters is difficult to make and practically inexploitable in an economic manner.

This example illustrates well the advantages attributed by the invention.

It is clear that the high frequency field, as has previously been said, should be controlled as a function of the material treated, such as will be easily determined by a man skilled in the art. According to the invention the action of the high frequency field should be preferably communicated to the yarn at a temperature lower than its normal thermal treatment temperature and generally less by 150° C. the temperature normally being obtained by means of a conventional oven.

The invention has been described applied to the treatment of false twisting, but it is clear that it could equally be applied to other fields and in general to all the textile treatments in which the material is displaced at high speed and which necessitates a heating operation.

I claim:

1. In a method of texturising a moving yarn which comprises the steps of continuously:

(a) delivering a moving yarn from a yarn supply;
(b) carrying out a first thermal treatment on the yarn;
(c) cooling the yarn and communicating to it a false twist which feeds back to the first thermal treatment zone;
(d) subjecting the yarn to a further heat treatment; and
(e) rewinding the untwisted yarn;

the improvement comprising:

(f) subjecting the yarn to a complementary treatment comprising the steps of wetting the yarn and then heating it by high frequency heating, said complementary treatment being effected at least between the first thermal treatment and the false twist spindle in order to cool the yarn.

2. A method as claimed in claim 1 wherein the complementary treatment of wetting the yarn and heating it by high frequency heating is effected after further heat treatment in order to cool the yarn before rewinding.

3. A method according to any one of claims 1 wherein the heating by high frequency is effected with a frequency of between 10 and 10,000 Mhz.

4. In an apparatus for texturising a moving yarn of the type comprising:

(a) means for storing a supply of yarn;
(b) yarn delivery means;
(c) first thermal treatment means;
(d) yarn cooling means;
(e) false twist producing means;
(f) further thermal treatment means; and
(g) withdrawal and rewinding means;

the improvement comprising:

(h) complementary treatment means comprising means for wetting the yarn and means for subjecting the yarn to a high frequency yarn heater, said complementary treatment means being positioned at least after said first thermal treatment means and before said false twist producing means.

5. Apparatus according to claim 4, wherein the high frequency yarn heating means comprise a high frequency field generator and a high frequency applicator of the cavity type.

6. Apparatus according to claim 4, wherein the high frequency yarn heating means comprises a high frequency field generator and a high frequency applicator of the piston type.

7. Apparatus according to claim 4, wherein the high frequency yarn heating means comprise:

(i) a magnetron generator;
(ii) means for holding a charge of water;
(iii) a circulator permitting the projection of the magnetron against a wave reflector and deviating it on a charge of water;
(iv) an elongate wave guide;
(v) means for blowing compressed air to evacuate the vapours due to the drying of the yarn;
(vi) an iris constituted by a plate having at its centre a circular hole, permitting the adaptation of the impedance at the level of the applicator,
(vii) a piston applicator through which the yarn can pass.

* * * * *

UNITED STATES PATENT AND TRADEMARK OFFICE

CERTIFICATE OF CORRECTION

PATENT NO. : 4,115,985

DATED : September 26, 1978

INVENTOR(S) : Jean Venot

It is certified that error appears in the above-identified patent and that said Letters Patent are hereby corrected as shown below:

Column 1, line 42, delete "combustion" and insert "conduction" therefor.

Column 5, line 66, delete "20" and insert "10" therefor.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*